US005784804A

United States Patent [19]

Nowakowski

[11] Patent Number: 5,784,804

[45] **Date of Patent: *Jul. 28, 1998**

[54] YANKEE HOOD WITH INTEGRAL AIR HEATING SYSTEM

[75] Inventor: George Z. Nowakowski, Montreal, Canada

[73] Assignee: Asea Brown Boveri, Inc., LaSalle, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 621,482

[22] Filed: Mar. 25, 1996

[51] Int. Cl.[6] ..... F26B 3/00

[52] U.S. Cl. ..... 34/446; 551/111; 551/112; 551/114

[58] Field of Search ..... 34/114, 115, 122, 34/478, 479, 79, 446, 551, 112

[56] References Cited

U.S. PATENT DOCUMENTS

| | | | |
|---|---|---|---|
| 3,163,502 | 12/1964 | Justus et al. | 34/114 |
| 3,167,408 | 1/1965 | Justus et al. | 34/122 |
| 3,377,056 | 4/1968 | Boye | 34/122 |
| 3,793,741 | 2/1974 | Smith, Jr. | 34/549 |
| 3,891,500 | 6/1975 | Kankaanpää | 162/274 |
| 4,064,637 | 12/1977 | Lindgren | 34/122 |
| 4,168,580 | 9/1979 | Weinmann | 34/122 |
| 4,462,169 | 7/1984 | Daane | 34/62 |
| 4,567,673 | 2/1986 | Böhnensieker | 34/23 |
| 4,656,759 | 4/1987 | Yamato | 34/134 |
| 4,743,419 | 5/1988 | Bierschenk | 264/83 |
| 4,942,675 | 7/1990 | Sundovist | 34/421 |
| 5,112,220 | 5/1992 | Wimberger et al. | 432/8 |
| 5,416,979 | 5/1995 | Joiner | 34/114 |
| 5,465,504 | 11/1995 | Joiner | 34/446 |

FOREIGN PATENT DOCUMENTS

| | | | |
|---|---|---|---|
| 677083 | 12/1963 | Canada . | |
| 713765 | 7/1965 | Canada . | |
| 795026 | 9/1968 | Canada | 34/39 |
| 2093066 | 10/1993 | Canada . | |

*Primary Examiner*—Henry A. Bennett
*Assistant Examiner*—Pamela A. Wilson
*Attorney, Agent, or Firm*—Konneker & Smith, P.C.

[57] ABSTRACT

A Yankee hood comprises an integral air heating system combining the hood with circulating fans, air heaters and an air flow duct work distribution system into one assembly with the air system apparatus located inside the hood. Motors for circulating fans and the burner assemblies are mounted on the external face of the hood drive side.

3 Claims, 5 Drawing Sheets

YANKEE HOOD WITH INTEGRAL AIR HEATING SYSTEM

FIELD OF THE INVENTION

This invention relates to paper drying systems and specifically to a Yankee hood having an integral air heating system.

BACKGROUND OF THE INVENTION

Yankee hood systems are used extensively in the manufacture of tissue by the paper industry. Conventionally, the Yankee hood systems have their air processing arrangements located externally of the hood, usually on a mezzanine floor or platform to take advantage of large spaces that are required to install combustion air heaters, circulating fans, their motors and the interconnecting duct work. Such a conventional arrangement would have an air processing system consisting of supply or circulating fans, exhaust fans, combustion chambers and blowers, a burner system and a fuel train all arranged outwardly of the Yankee hood and interconnected with the hood structure through suitable duct work.

Large amounts of capital investment are required to engineer and construct a mezzanine floor, equipment foundations and burner room to enclose air heaters and duct work systems. Similarly, large amounts of capital investment are required also to design and build the necessary external air flow duct work distribution systems. Duct work pressure losses between the apparatus and the hood contributes to additional electrical energy consumed by the circulating fans of the air circulation system and this additional energy constitutes upwards of 15 to 20% of the total electrical energy consumed by these fans. As an example, a medium sized Yankee hood system may consume up to 400 kw/hour.

The present invention addresses the shortcomings of conventional Yankee hood arrangements with external air heating systems by providing a high performance Yankee hood incorporating an integral air heating system thus combining the hood with circulating fans, air heaters and air flow duct work distribution systems into a single assembly with the air system apparatus located inside the hood.

PRIOR ART

Canadian Patent 677,083 of Dec. 31, 1963 relates to a method and apparatus for drying a web-like material by supplying a gaseous treatment medium to the web in the form of jets being caused to impinge substantially perpendicularly against the surface of the web. The jets are evenly distributed over the entire surface of the web to be treated and the drying medium is discharged from the web at a number of exhaustion points so that the medium is forced to flow along the web from all directions radially towards the exhaustion points.

Canadian Patent 713,765 of Jul. 20, 1965 discloses a compact unit including a distribution system within the confines of one enclosure.

Canadian Patent 795,026 of Sep. 24, 1968 discloses a compact dryer where the plenum chamber serves simultaneously as a combustion and mixing chamber.

U.S. Pat. No. 5,416,979 of May 23, 1995 discloses a paper web dryer and moisture profiling system where a plurality of gas burners are individually located in each of the nozzle box interiors and are arranged side-by-side along the length of the nozzle box interiors to produce the hot combustion gases for drying.

Other examples of the prior art are to be found in U.S. Pat. Nos. 3,163,502 Dec. 29, 1964; 5,112,220 May 12, 1992; 4,743,419 May 10, 1988; 4,168,580 Sep. 25, 1979, this arrangement showing a drying installation for a paper web including a drying hood having flow channels, heat sources and blowers for circulation of drying medium; 4,064,637 Dec. 27, 1977; 3,891,500 Jun. 24, 1975; 4,656,759 Apr. 14, 1987; 4,567,673 Feb. 4, 1986; and 4,462,169 Jul. 31, 1984.

While some of the above listed specifications are directed to apparatus for increasing efficiency in web drying processes, they do not disclose the assembly of elements and combination of features found in the present invention.

SUMMARY OF THE INVENTION

According to a broad aspect, the invention relates to a Yankee hood assembly having an integral air heating and distribution system. The assembly comprises a Yankee hood enclosure which is adapted to envelope a portion of a dryer cylinder, the hood enclosure having a wet end and a dry end. A plurality of internal moisture profiling sections are arranged across the inner operative face of the hood enclosure and moisture profiling headers located internally of the hood enclosure are provided for feeding air to the profiling sections. Air circulating fans are mounted inside of the hood enclosure, one in each half thereof, and an internal combustion system is located downstream of each circulating fan and intermediate the fan and the air distribution system.

BRIEF DESCRIPTION OF THE DRAWINGS

The invention is illustrated by way of example in the accompanying drawings in which.

DESCRIPTION OF A PREFERRED EMBODIMENT

Figure 1:
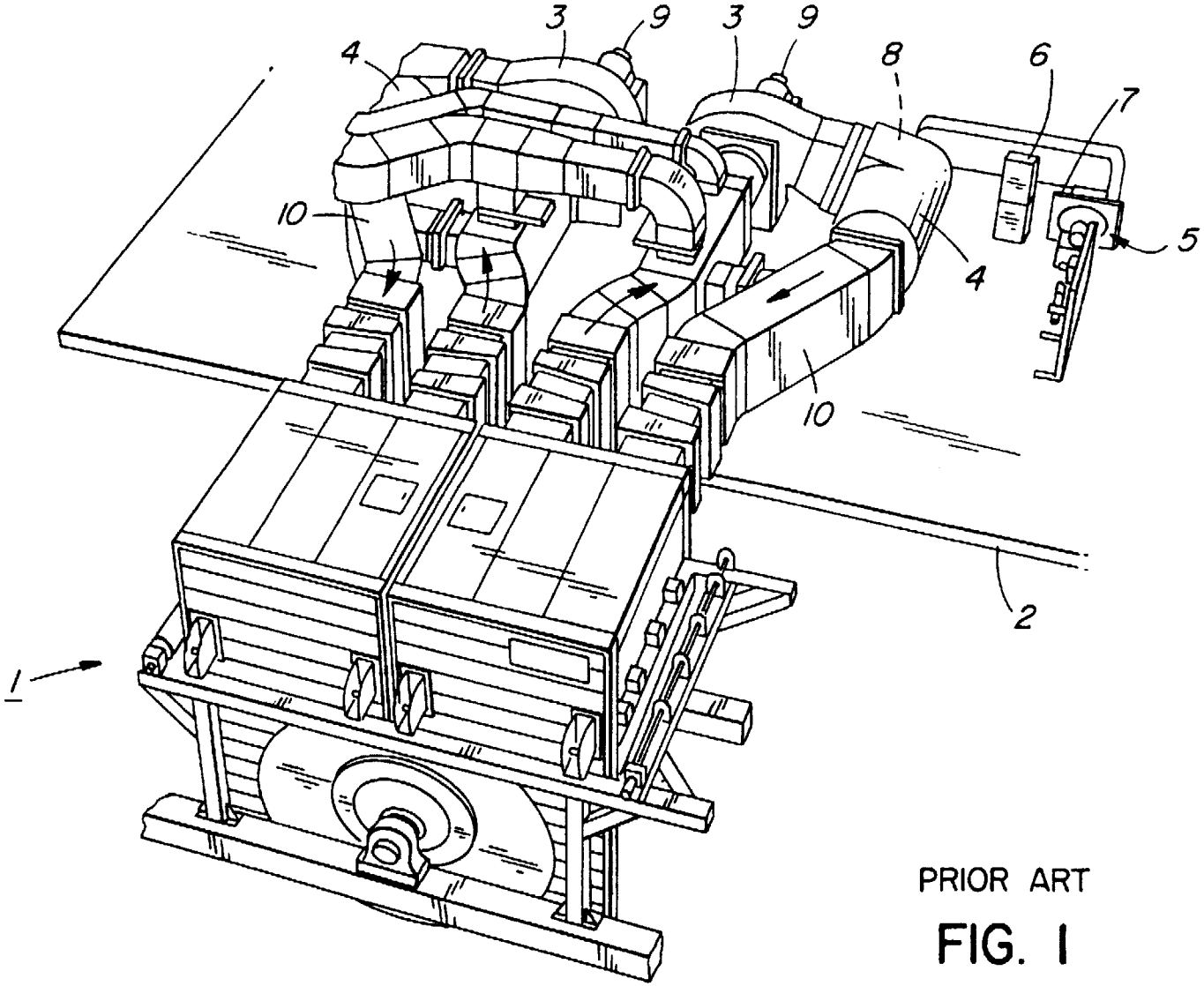
PRIOR ART FIG. 1
FIG. 1 is a perspective view of a conventional Yankee hood arrangement illustrating the associated air heating system.

Referring to FIG. 1, a commonly used Yankee hood system is illustrated. The Yankee hood enclosure 1 is connected to an external air heating system located on a mezzanine floor 2 adjacent the Yankee hood and its associated drying cylinder. This conventional system includes a pair of air supply or circulating fans 3, combustion chambers 4, a fuel train illustrated generally at 5, a burner control panel 6, combustion blowers 7 and burner systems 8 associated with the combustion chambers 4. Suitable motor means 9 are located to drive the supply fans 3.

The air heating and blower elements are interconnected with the Yankee hood structure by way of a plurality of ducts 10. It will be noted that the mezzanine 2 takes up a large amount of space in order to locate the combustion air heaters, circulating fans, motors and the circulating fans together with the interconnecting duct work etc.

Figure 2:
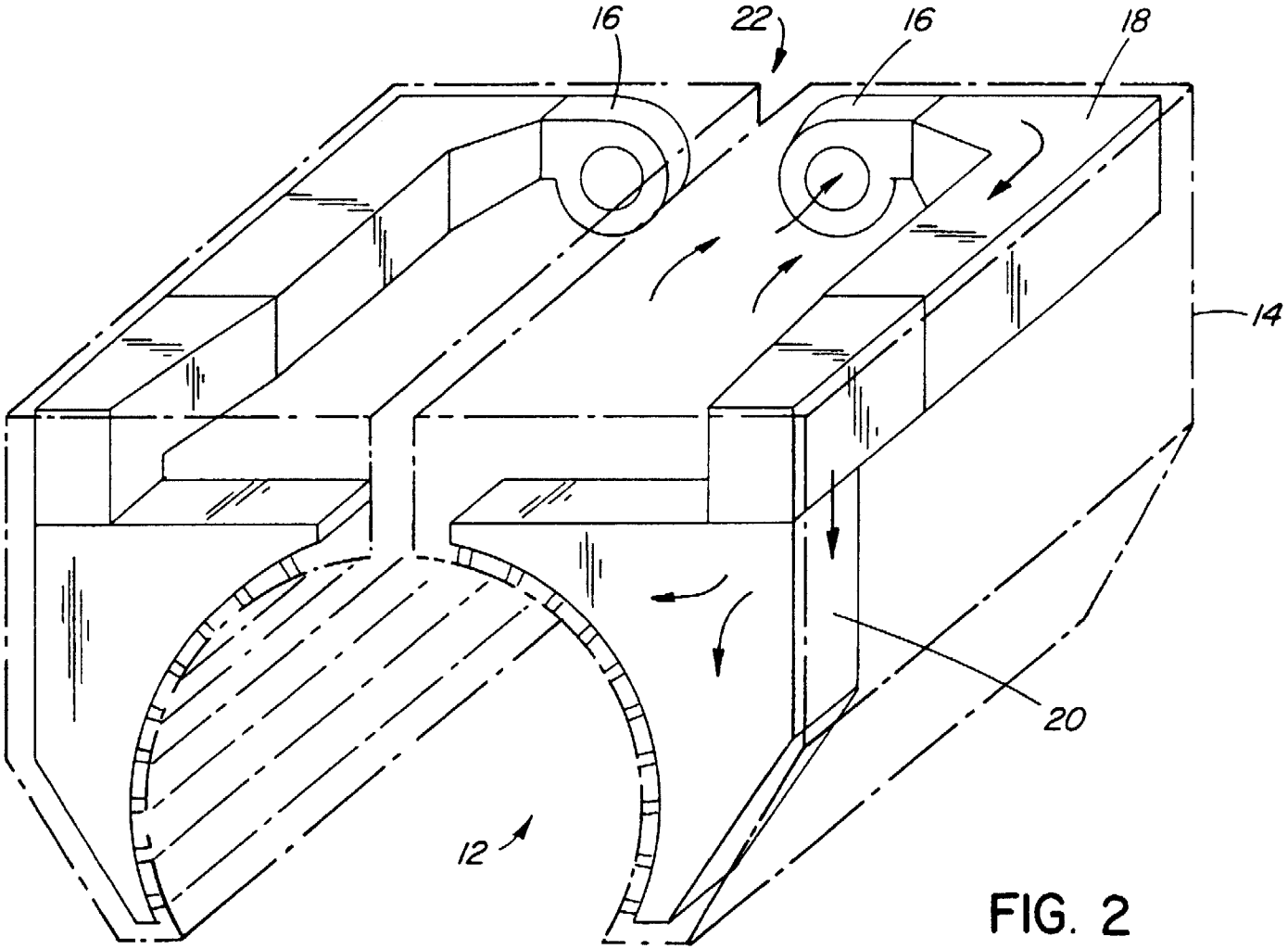
FIG. 2 is an isometric view of the present invention in conceptual form.

With reference to FIG. 2, a Yankee hood 12 according to the invention comprises an integral air heating system to thereby combine the hood with circulating fans, air heaters and air flow duct work with the air system apparatus located within the confines of the hood envelope illustrated at 14. The envelope encloses the air circulating fan 16, the air heater assembly 18 and the air distribution system 20. The air circulating fans and heater assembly are located adjacent the drive side 22 of the hood.

Figure 3:
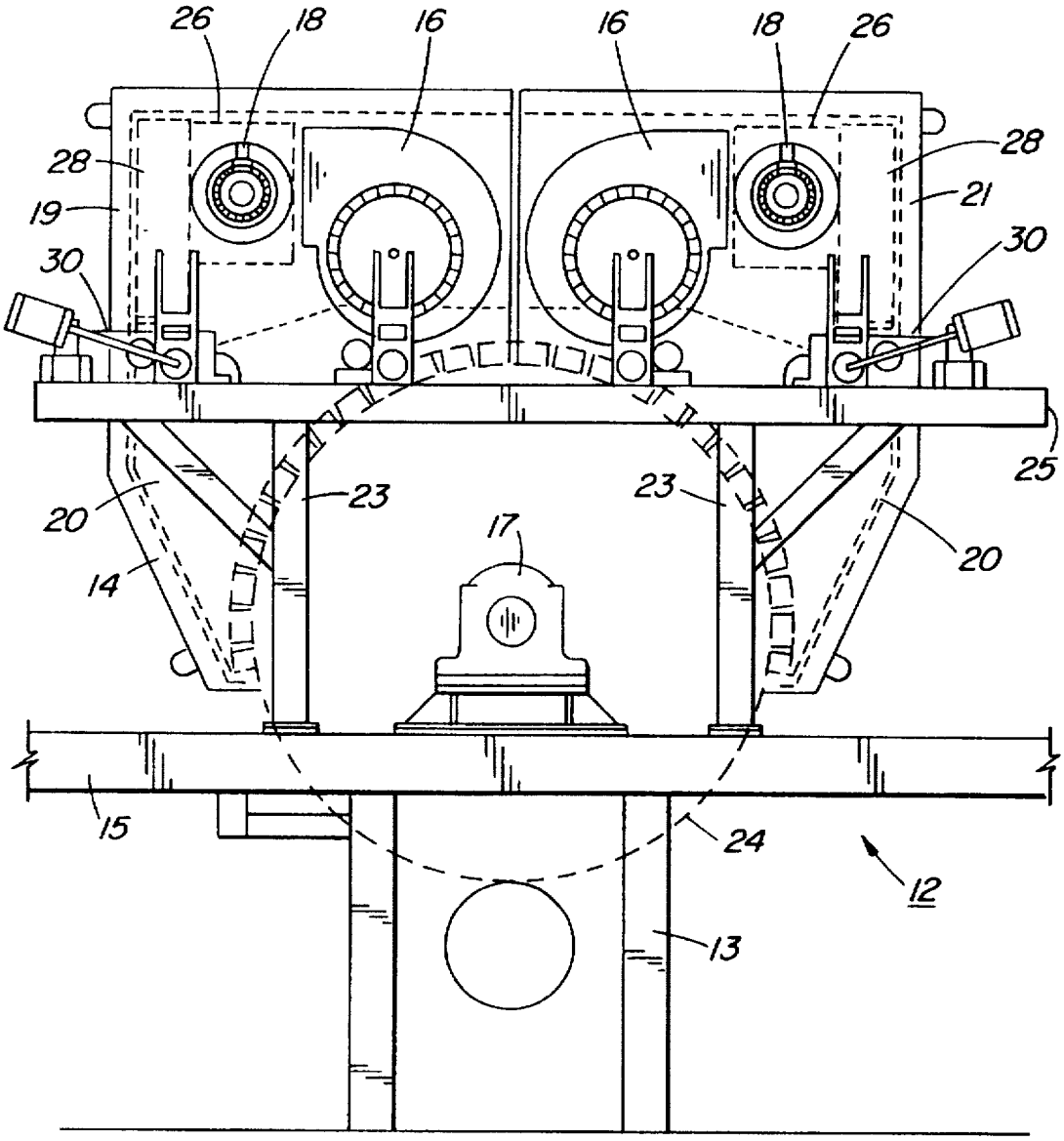
FIG. 3 is an elevation view of a Yankee hood arrangement according to the invention.
Figure 4:
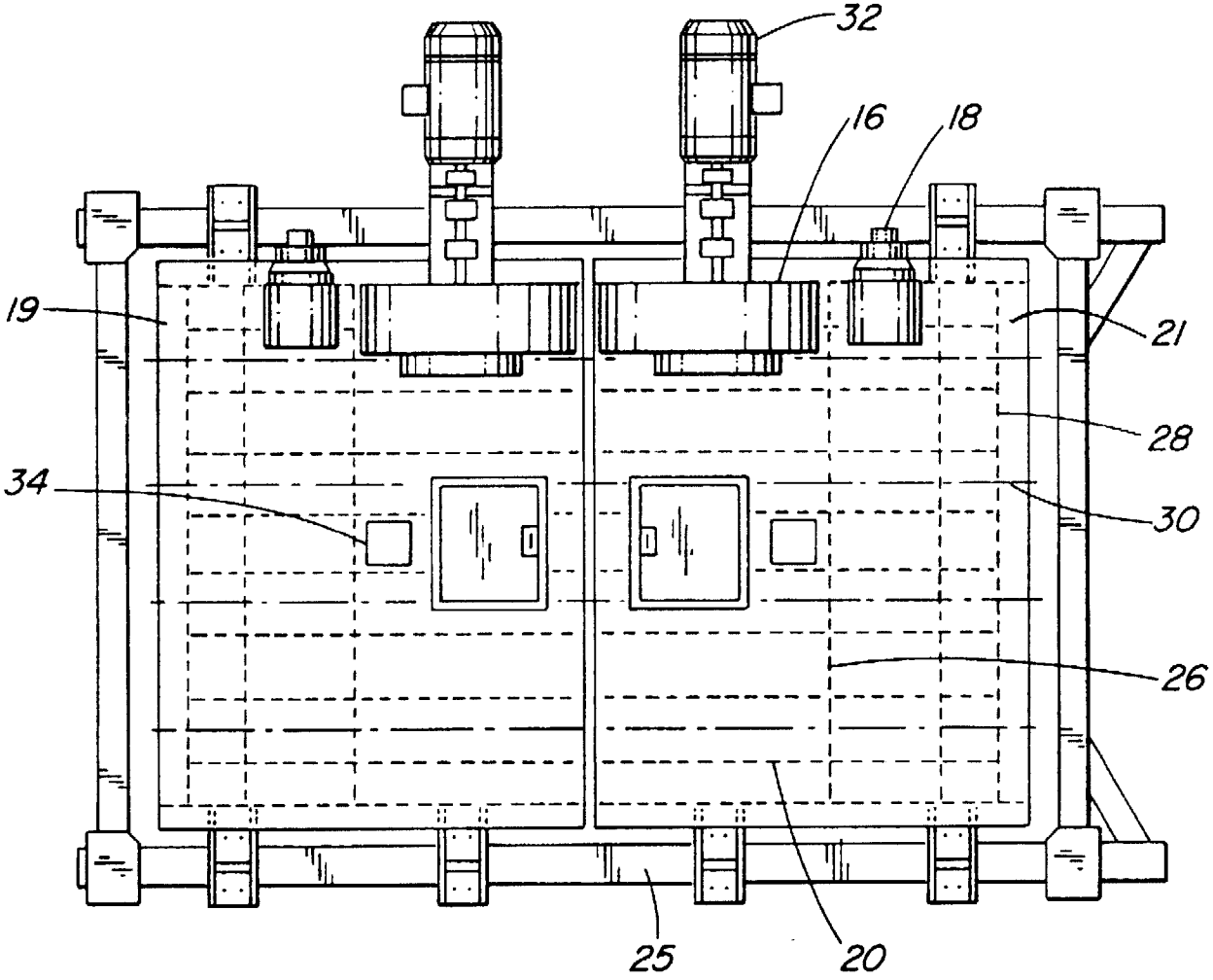
FIG. 4 is a plan view of the arrangement shown in FIG. 3.
Figure 5:
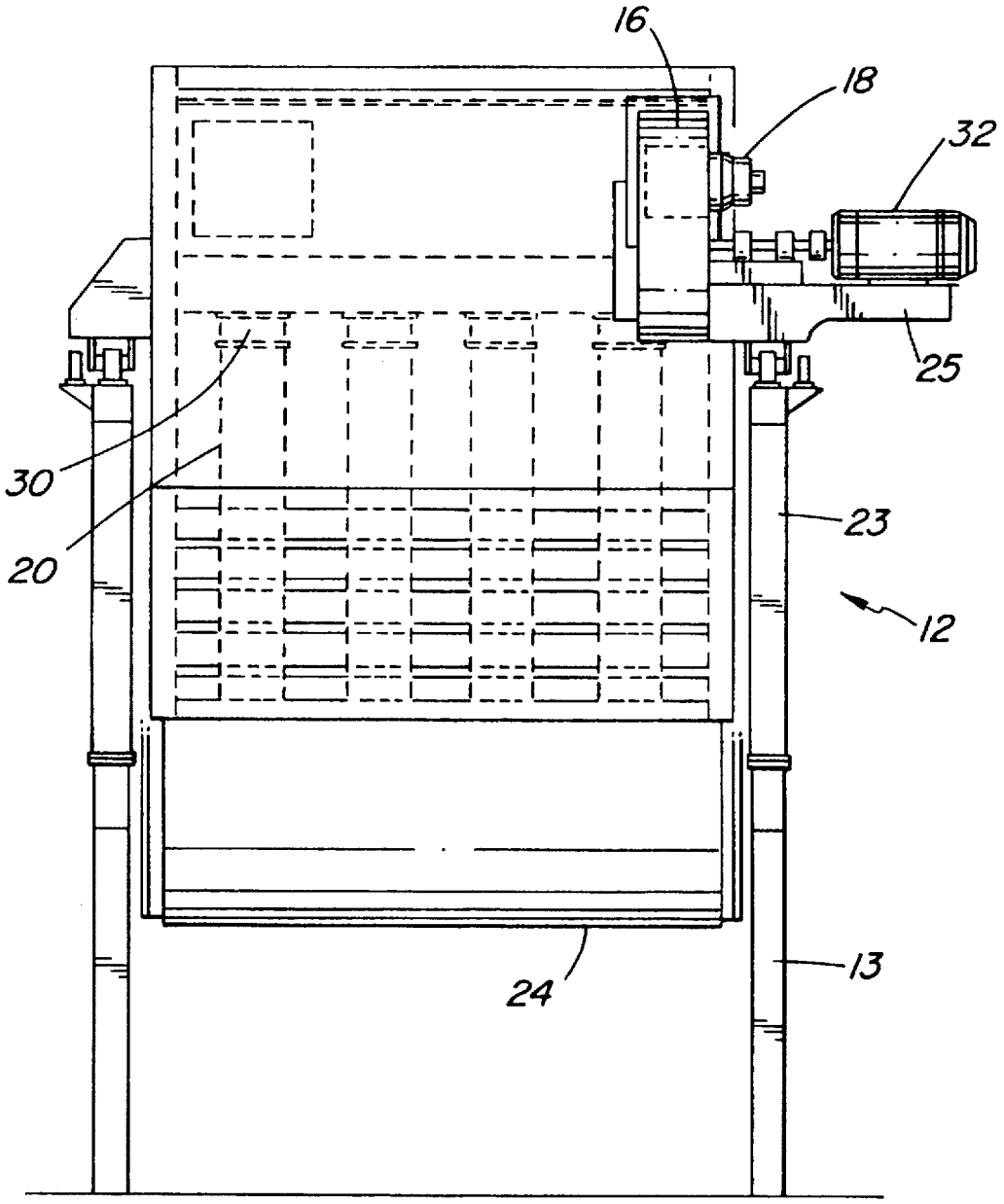
FIG. 5 is a side view of the arrangement shown in FIG. 3.

The invention is shown in greater detail in FIGS. 3, 4 and 5. The Yankee hood 12 with the integral air heating system includes the Yankee hood envelope 14 positioned around a drying cylinder 24 located on a suitable foundation 13 supporting a floor 15 on which the dryer cylinder bearings 17 are located. The Yankee hood envelope 14 is subdivided into left and right halves 19 and 21 and would include suitable means for moving those halves for servicing purposes. The hood 14 is positioned on steel hood supports 23, 25.

As shown in FIG. 3, the air circulating fans 16 are located in the upper ends of the drive side of the hood with the burners 18 being located adjacent the fans. The air flow equalizing chamber assembly consists of two key components, the combustion chambers 26 and the profiling headers 28. The function of the assembly is to provide the profiling sections 20 with even air flow and temperature distribution in the cross-machine direction, from the tending side to the drive side.

The internal combustion process takes place in the combustion chambers 26, producing an air flow that is mixed to obtain an even temperature at its end before entering the profiling headers. Temperature mixing is achieved using mixing devices that are located within the chambers.

The profiling headers 28 with its envelope separate from the combustion chamber 26 produces an even exit air flow to each profiling section 20. The individual air flow volumes prior to exiting the headers are equalized using static pressure drop devices and flow adjustment profiling dampers 30. The internal combustion chambers 26 extend across the internal width of the hood envelope as shown in FIG. 4 adjacent the internal moisture profiling header 28 provided with a series of air dampers 30. The profiling headers feed the drying medium into the moisture profiling sections 20 and these sections 20 are arranged across the inner operative face of the hood enclosure.

Dampers 30 associated with the air profiling sections 20 provide air flow quantity adjustments prior to discharge of the air on to a paper web located on the drying cylinder 24.

As shown in FIG. 4, the motor means for driving the fans 16 are in the form of electric motors 32 located externally of the hood on the drive side thereof. Air exhaust openings 34 are provided on the top of the hood envelope as shown in FIG. 4. The wet end half of the hood will be connected with the dry end half to provide air cascading for greater energy efficiency.

It will be noted from FIG. 4 that the perimeter frame 25 requires substantially less space to support the hood arrangement according to the invention than that disclosed in the prior art arrangement of FIG. 1.

With the internal combustion system located on the downstream side of the circulating fans 16, both elements of which are installed inside the envelope with one fan and one burner per hood half, and with the hood having a paper web cross machine moisture profiling capability together with the air profiling sections and dampers to allow for air flow quantity adjustment prior to discharge on to the paper web, this arrangement according to the invention provides a high performance Yankee hood for use in the paper industry.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. A Yankee hood assembly having an integral air heating and distribution system, said assembly comprising:

a Yankee hood enclosure adapted to envelope a portion of a dryer cylinder, said hood enclosure having two halves, a wet end and a dry end;

a plurality of internal moisture profiling sections arranged across the inner operative face of each half of said hood enclosure;

dampers associated with said air profiling sections to provide air flow quantity adjustment prior to discharge of said air onto a paper web on said dryer cylinder;

moisture profiling headers located internally of the hood enclosure for feeding air to said profiling sections;

each half of said Yankee hood enclosure incorporating (a) a single air circulating fan mounted internally thereof; and (b) an internal combustion system located downstream of said single circulating fan and intermediate said fan and the air distribution system.

2. A hood according to claim 1 including motor means located externally of said hood for driving said circulating fans located internally of said hood.

3. A hood according to claim 1 wherein said wet end and said dry end of the hood are interconnected to provide air cascading for greater energy efficiency.

* * * * *